United States Patent [19]

Adams

[11] 4,102,062

[45] Jul. 25, 1978

[54] SAFETY BOOT WITH METATARSAL PROTECTION

[75] Inventor: Richard R. Adams, Bettendorf, Iowa

[73] Assignee: Chromalloy American Corporation, St. Louis, Mo.

[21] Appl. No.: 816,805

[22] Filed: Jul. 18, 1977

[51] Int. Cl.[2] ..... A43B 13/22

[52] U.S. Cl. ..... 36/72 R

[58] Field of Search ..... 36/77 R, 4, 72 R

[56] References Cited

U.S. PATENT DOCUMENTS

| | | | |
|---|---|---|---|
| 1,970,157 | 8/1934 | Williams | 36/72 R X |
| 2,537,891 | 1/1951 | Greenan | 36/77 R |
| 2,724,676 | 11/1955 | Randall et al. | 36/4 X |
| 3,308,560 | 3/1967 | Jones | 36/4 |
| 3,407,518 | 10/1968 | MacQuaid et al. | 36/72 R |
| 3,841,004 | 10/1974 | Gray et al. | 36/72 R |

*Primary Examiner*—Alfred R. Guest

*Attorney, Agent, or Firm*—Strauch, Nolan, Neale, Nies & Kurz

[57] ABSTRACT

A safety boot has a lower foot receiving portion incorporating wearer instep protection in the form of a relatively rigid inverted U-shaped guard of hard non-brittle synthetic plastics material extending over the metatarsal region of the wearer's foot and downwardly at opposite sides to terminate in edges in substantial abutment with the sole whereby impact and crushing forces are transmitted substantially straight down the sides to be distributed and absorbed along the sole.

9 Claims, 3 Drawing Figures

FIG. 1
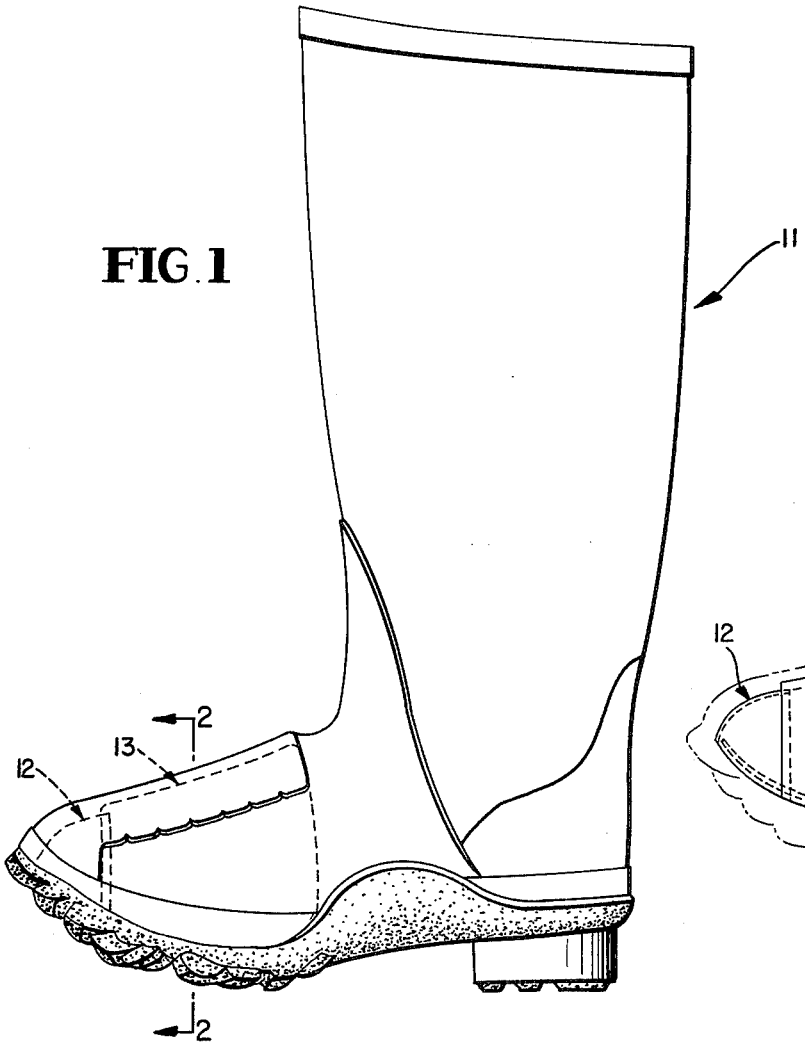
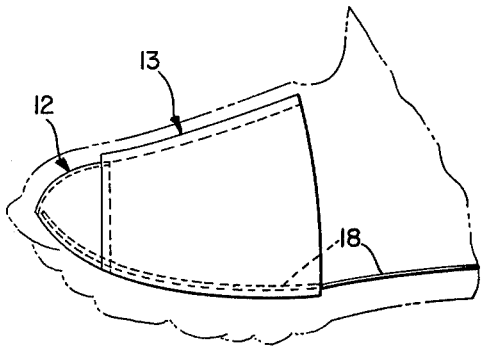
FIG. 3
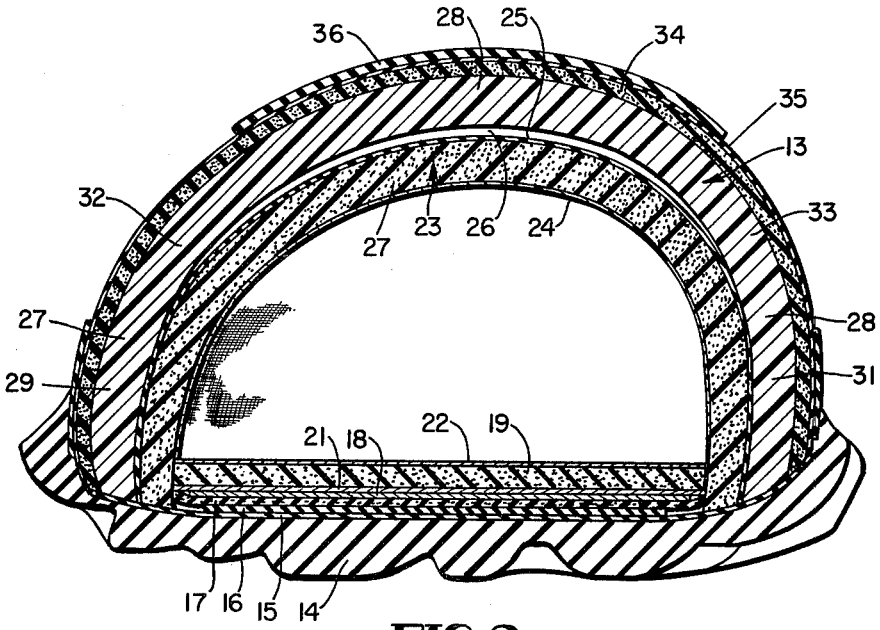
FIG. 2

SAFETY BOOT WITH METATARSAL PROTECTION

This invention relates to industrial and like safety boots and particularly to incorporation therein of high impact resistant protective structure for the wearer's foot forwardly of the ankle.

The human foot in the instep or metatarsal region that extends forwardly from the ankle region to the bone structure at the inner ends of the toes is arched and contains a number of elongated bones extending side by side. This forward part of the foot is particularly vulnerable to impact and crushing forces, especially falling or dropped weights and puncture by sharp points or edges such as are encountered in industrial operations, and safety regulations have been established for protection against such forces. For example current ANSI/OSHA specifications set goals for such protection.

It has long been known to incorporate relatively rigid impact resistant metal toe protectors in shoes and boots, as for example disclosed in Murray et al U.S. Pat. No. 2,020,037. It has further been proposed to include in addition to such toe protectors instep guards such as disclosed in U.S. Patents to MacQuaid No. 3,108,386, Turner No. 3,178,836 and Schlect No. 2,972,824 which latter discloses a more or less built-in instep protector of synthetic plastic.

The present invention provides in a boot or the like novel instep or metatarsal protection in the form of an incorporated relatively rigid guard of synthetic plastic wherein the material, shape and structure combine to prevent collapse even under stringent crushing and impact conditions such as those set out in the above-mentioned ANSI standards, and this is the major object.

Pursuant to this object the invention provides a built-in metatarsal or instep guard that is generally of inverted U-shape with opposite sides so constructed and arranged that forces applied to the upper surface of the boot in this region will be directed and conducted substantially straight downwardly along the downwardly extending sides of the guard to be distributed and absorbed along the sole of the boot and the floor or like surface on which the boot is resting.

Further pursuant to this object the sides of the guard are so constructed and arranged that their bottom edges do not tend to deflect outwardly under impact and crushing conditions.

BRIEF DESCRIPTION OF DRAWINGS

FIG. 1 is a side elevation of a boot incorporating the invention according to a preferred embodiment;

FIG. 2 is a section substantially on line 2—2 of FIG. 1 showing detail; and FIG. 3 is a somewhat diagrammatic partial view mainly for aid in showing relative location of the metatarsal guard and the toe protector element.

PREFERRED EMBODIMENTS

FIG. 1 illustrates a safety boot 11 essentially of the industrial type having an upper leg receiving portion and a bottom foot receiving portion and incorporating the special metatarsal protector of the invention.

In the boot there is incorporated a suitably rigid metal toe protector element 12 that extends over and protects the wearer's toes against damage such as due to a heavy weight impact or crushing force exerted in that region. Such metal toe protectors are fairly conventional.

In the invention a special rigid guard 13 comprising an integral element of synthetic plastic shaped and disposed to extend protectively over the upper metatarsal region or instep of the wearer is incorporated in the safety boot.

Referring to FIG. 2 it will be seen that the boot comprises a thick rubber sole 14 above which are successive layers of rubber 15, a firm rubber compound 16 and foam rubber 17, a metal plate 18 and a cushioning foam rubber layer or pad 19 having fabric layers 21 and 22 on opposite sides. These layers, the sole and the metal plate are bonded together under heat and pressure, as by vulcanization. Upstanding from these layers is a generally inverted U-shaped cushioning layer 23 of foam rubber having fabric layers 24 and 25 bonded on opposite sides. The lower ends of layer 23 are bonded to the sole and the bottom layers whereby to define the enclosure through which the wearer's foot extends.

The metatarsal guard 13 is of inverted U-shape and extends over the cushion layer provided at 23, but with a space 26 therebetween at least at their respective arcuate downwardly concave sections 27 and 28. As shown in FIG. 2 the opposite downwardly extending sides of guard 13 are substantially vertically straight at their lower ends 29 and 31 and seat at their lower edges on the thin rubber layer 15 so that they are effectively in end abutment with the thick rubber sole. The upper ends of the guard sides are joined to central portion 28 by smoothly curved transition sections 32 and 33.

Above guard 13 extends a cushioning layer of foam rubber 34 encased in an extension of rubber layer 15 indicated at 35, with an upper external patch of colored rubber 36. These layers are bonded together and to the rubber of the sole at their lower ends.

The metal toe protector 12 extends over the front part of cushion layer 27 with its rear edge about level with space 26 and slightly underlapping and supporting the front edge of guard 13.

Guard 13 is of uniform thickness and preferably formed by being premolded to shape from a sheet of suitable hard but non-brittle synthetic plastic. A plastic which has been found quite suitable is an acrylic modified polyvinylchloride that is marketed by Rohm and Haas under the Trademark KYDEX. Another material may be that disclosed in U.S. Pat. No. 3,629,050. Any functionally and physically equivalent plastic may be used in the invention.

The shape of guard 13 is essentially that of the bootlast, so that its incorporation does not interfere with conventional boot forming techniques. In making the boot of the invention the bottom layers, including the metal plate 18, and the cushion layer 27 are placed on the last, and the preshaped metal toe protector and plastic instep guard placed over the cushion layer, with the toe end of guard 13 overlying the rear edge of toe protector 12. Then the sole and outer layers are applied and the assembly vulcanized.

The guard 13 is thus completely enclosed within the boot structure which is otherwise conventional.

The novel synthetic plastics metatarsal guard of the invention is considerably lighter in weight than a metal guard of the same mass and shape and as a result of its novel structure it is advantageous with respect to thinner metal guards in that it inherently has the characteristic of returning toward shape even when it may deform under excessive impact or crushing force. A thin steel guard may tend to retain deformation and trap the foot under excess load conditions while a thicker metal guard would add weight, and affect the wearer of the boot. In addition it is preferable as described that the molded plastic metatarsal guard be essentially free of surface bonding to the adjacent flexible layer or layers of rubber and fabric constituting the main boot structure. This allows the guard to have some small freedom for temporary deformation and return to shape. The dimensions are such that the wearer's foot extends with a comfortable fit into the enclosure provided by the inner cushion layers 19 and 23, so that he is not conscious of the stiff protecting guard. The metal plate 18 protects against puncture as by nails.

In the final assembly the foot enclosing portion which is essentially surrounded by foam rubber layers 19 and 23 provides for flexibility, freedom and comfort of the wearer. The rigid guard 13 does not interfere with fit of the boot to the wearer's foot. The added upper foam rubber layer 34 improves the protection.

Referring again to FIG. 2, should a heavy weight fall from above on the foot portion of the boot, the impact force will be mainly applied to the central section 28 of guard 13 and transmitted down the sides to be distributed and absorbed at the sole. Under severe impact which might temporarily slightly deform the central section 28 the force is either not passed on to the wearer's foot or is cushioned by layer 23. The guard 13, even under very heavy impact loads, will strongly resist any change in its shape or position, and the sides 27 and 28 will not tend to spread outwardly under impact or crushing so that the wearer's foot is fully protected.

While the invention is described as applied to boots having leg receiving portions it is applicable to boots having other types of uppers. The term boot as used herein includes shoes and like footwear.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a safety boot having an upper portion and a lower foot receiving portion extending from an ankle region to a toe enclosing region and a sole on the bottom of said foot receiving portion, means incorporated in said foot receiving portion providing wearer instep protection comprising a U-shaped guard of hard non-brittle synthetic plastics material extending arcuately at its upper part over the metatarsal portion of the wearer's foot and extending substantially straight downwardly at its sides at opposite sides of the wearer's foot to terminate in edges in substantial abutment with the sole whereby impact and crushing forces are transmitted substantially straight down said sides to be distributed and absorbed along said sole, said guard being relatively rigid but capable of temporary deformation and return to shape under excessive impact, and said foot receiving portion comprising an inner cushion wall region for extending around and enclosing the wearer's foot inwardly of said guard free of attachment to said upper part of said guard.

2. On the safety boot defined in claim 1, said guard being a substantially inverted U-shaped molded element wholly enclosed within said foot receiving portion.

3. The safety boot defined in claim 2, wherein said element is of substantially uniform thickness and its opposite sides terminate in substantially straight end portions.

4. The safety boot defined in claim 2, wherein a rigid toe protector is incorporated in said toe enclosing section and the forward end of said guard overlaps the rear end of said toe protector.

5. The safety boot defined in claim 1, wherein said sole is relatively thick and composed of natural or synthetic rubber whereby to absorb impact and crushing forces transmitted down said sides of said guard.

6. The safety boot defined in claim 1, wherein said guard is composed of acrylic modified polyvinyl chloride sheet material molded to shape.

7. The safety boot defined in claim 1, wherein said foot receiving portion comprises outer cushion walls extending substantially coextensively with said guard outwardly of said guard.

8. The safety boot defined in claim 7, wherein a toe protector in the form of a rearwardly open metal box-like element is incorporated in said toe enclosing region, said guard extends from said toe protector substantially to said ankle region, and a metal plate is incorporated in the cushion wall at the bottom of said foot receiving portion.

9. In the safety boot defined in claim 1, means whereby a space is provided between said upper arcuate part of said guard and said inner cushion wall region.

* * * * *